US006474118B2

(12) United States Patent
Martinez

(10) Patent No.: US 6,474,118 B2
(45) Date of Patent: Nov. 5, 2002

(54) SCISSORS LATCH LOCK

(75) Inventor: Richard A. Martinez, River Forest, IL (US)

(73) Assignee: CompX International Inc., Maudlin, SC (US)

( * ) Notice: Subject to any disclaimer, the term of this patent is extended or adjusted under 35 U.S.C. 154(b) by 23 days.

(21) Appl. No.: 09/821,450

(22) Filed: Mar. 29, 2001

(65) Prior Publication Data

US 2002/0139154 A1 Oct. 3, 2002

(51) Int. Cl.[7] ..... E05B 63/14

(52) U.S. Cl. ..... 70/123; 292/27; 292/49; 292/129; 292/229

(58) Field of Search ..... 70/123, 100; 292/27, 292/49, 229, 11, 129

(56) References Cited

U.S. PATENT DOCUMENTS

| | | | | |
|---|---|---|---|---|
| 1,410,581 A | 3/1922 | Langer | ..... | 70/106 |
| 1,512,141 A | 10/1924 | Segal | ..... | 70/106 |
| 1,563,914 A | 12/1925 | Muzzio | ..... | 70/123 |
| 1,601,359 A | 9/1926 | Harrington | ..... | 70/100 |
| 2,720,774 A | 10/1955 | Gehrie | ..... | 70/71 |
| 2,887,865 A | 5/1959 | Moler | ..... | 70/149 |
| 2,943,878 A | 7/1960 | Rigaud | ..... | 292/44 |
| 3,899,201 A | 8/1975 | Paioletti | ..... | 292/25 |
| 4,836,707 A | 6/1989 | Myers | ..... | 403/322 |
| 4,976,123 A | 12/1990 | Ceron et al. | | |
| 5,119,654 A | 6/1992 | Ceron et al. | | |
| 5,209,530 A | 5/1993 | Kolloch | ..... | 292/27 |

*Primary Examiner*—Anthony Knight
*Assistant Examiner*—John B. Walsh
(74) *Attorney, Agent, or Firm*—Banner & Witcoff, Ltd.

(57) ABSTRACT

A lock for attaching a cover to a platform includes first and second pivotally mounted latch bars which spread to engage side walls of a strike opening in response to actuation of a key actuated rotatable plug mounted in the housing of the lock. The latch bars are mechanically spread to engage the strike in a positive manner and do not rely upon biasing means to maintain the lock in the locked position.

7 Claims, 3 Drawing Sheets

SCISSORS LATCH LOCK

BACKGROUND OF THE INVENTION

In a principal aspect, the present invention comprises a lock useful for latching a cover to a platform and, more particularly, to a lock having a bolt comprised of opposed and pivoting latch members which positively lock with opposite sides of a strike opening.

Storage containers, hard top carriers, and various types of enclosures desirably require the use of a lock which enables lifting of an enclosure cover from a platform when the locking member of the lock is in the unlocked position and positive locking or latching of the cover to the platform when the cover is lowered against the platform to a closed position. Prior art systems which have been used for latching, for example, a car top carrier box against a platform, incorporate latching levers which are biased to a locked position by a spring member. To unlock such a mechanism it is necessary to have a means for mechanically engaging the levers and move them against the biasing force of the spring thereby releasing the latch. Should the spring break or otherwise become disabled through corrosion or due to other circumstances, the lock may become disabled. As a consequence development of a lock mechanism which does not require a spring means in order to maintain the lock in the locked position is deemed desirable.

Prior art patents which exemplify locks designed for such environments include U.S. Pat. No. 4,976,123 and U.S. Pat. No. 5,119,654. While such lock mechanisms are useful, there has remained a need for an improved lock mechanism particularly for use in combination with car top carriers and other types of enclosures wherein a box-like enclosure is fitted against a platform and it is desired to lock the enclosure to the platform.

SUMMARY OF THE INVENTION

Briefly the present invention comprises a lock which includes a housing that is generally planar in construction with pivotally attached first and second, planar bolt lever arms. A cylinder with a key actuated plug is also mounted in the housing in a manner which permits a rotatable stud extending from the plug to project between the two bolt lever arms. The stud is configured so that when the plug is rotated by actuation of a key, the end of the stud will engage the lever arms causing them to pivot thereby separating and positively engaging the opposite sides of a strike. The plug is constructed so that the key can be removed from the plug only when the plug is in the locked position. When in the locked position, the bolt lever arms are positively, mechanically engaged by the actuating stud and locked to the strike. Consequently, even though springs are provided to bias the bolt lever arms toward the unlocked position, failure of the springs when the lock is in the locked position will not result in failure of the lock. The lock will remain in the locked position since it is mechanically forced and maintained in that position by the projecting stud which engages the bolt lever arms.

The lock further includes features which facilitate its utility to hold a carrier box in combination and joined to a platform. Thus there is a protective tongue or plate associated with the housing which fits over and parallel to the bolt lever arms to protect the lever arms and prevent them from being inadvertently engaged. The geometry of the housing and the bolt lever arms is chosen so as to physically protect the lever arms and provide the most beneficial mechanical advantage when operating the lever arms. The housing is fashioned and fabricated in a manner which protects the user from the moving parts of the lock and which also enhances the ability to easily mount the lock in a manner which promotes sealing or water tight installation.

Thus it is an object of the invention to provide an improved lock construction for use in many environments and especially for use in combination with hard top carriers and similar types of storage assemblies.

It is a further objection of the invention to provide a lock which includes a mechanism for positively engaging bolt members with a strike when the lock is in the locked position.

Yet another object of the invention is to provide a lock which includes a minimum number of mechanical parts, which may be efficiently and easily manufactured, which is economical, and which is easy to install.

These and other objects, advantages, and features of the invention will be set forth in the detailed description which follows.

BRIEF DESCRIPTION OF THE DRAWING

In the detailed description which follows reference will be made to the drawing comprised of the following figures.

DESCRIPTION OF THE PREFERRED EMBODIMENT

Figure 1:
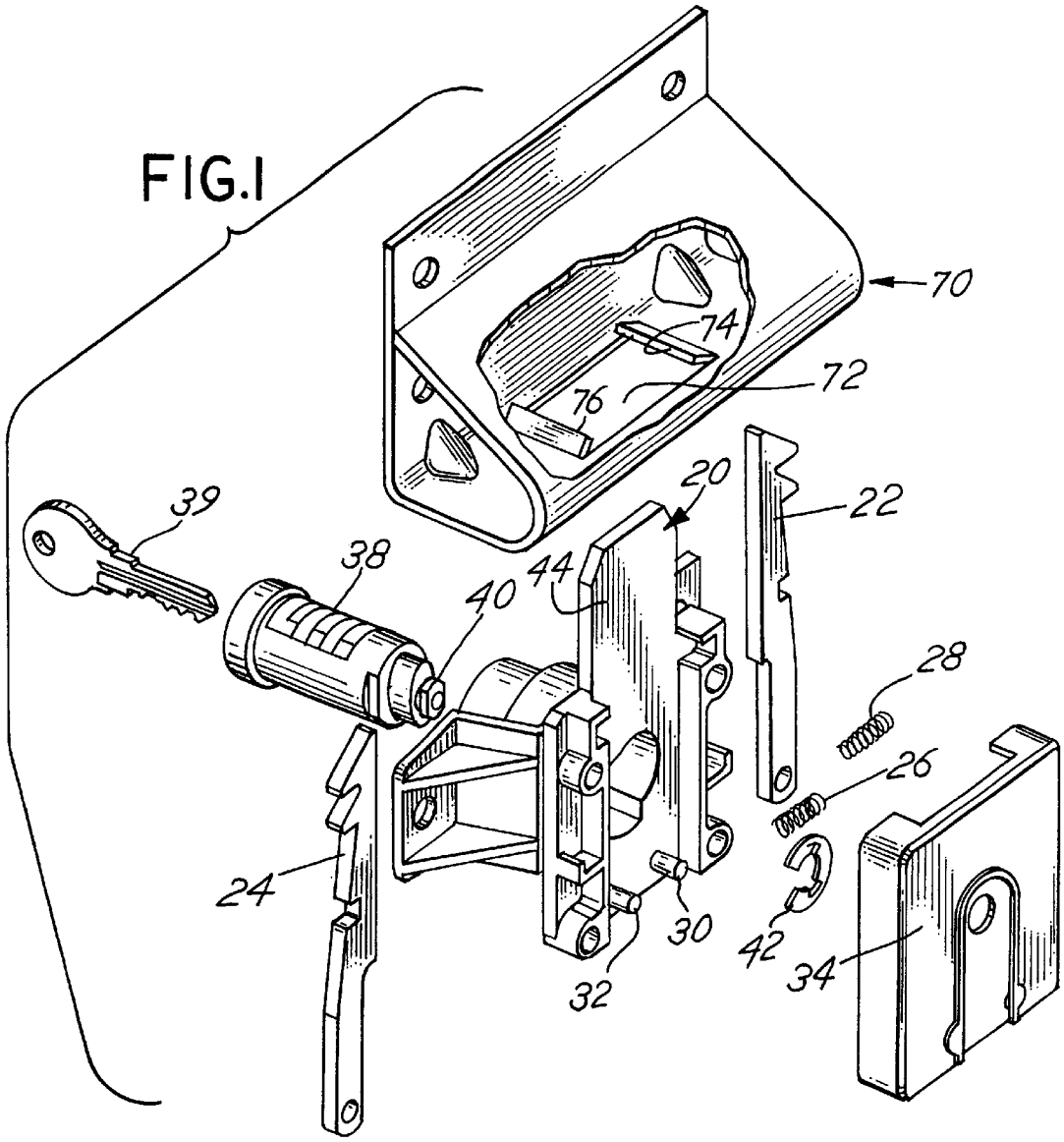
FIG. 1 is an exploded isometric view of the lock construction of the invention.

Referring to the figures, the embodiment of the invention includes a bracket 20 with first and second lever arms or latch bars 22 and 24 pivotally mounted thereon and biased respectively by springs 26 and 28 for pivotal movement toward one another about pivot connections, pivot points, or pivot support studs 30 and 32, respectively. A protective cover 34 fits over and facilitates retention of the bolt members or latch bars 22 and 24 on studs 30, 32. The lock further includes a cylinder 36 integrally cast or formed with and projecting axially from the bracket 20 transverse to the plane of rotation of latch bars 22, 24. Cylinder 36 includes a rotatable plug 38 mounted for axial rotation in the cylinder 36. The plug 38 includes a projecting, generally elliptically shaped, inner end stud 40 which is designed to cooperate and actuate the latch bars or bolts 22 and 24 as described hereinafter. A retainer clip 42 fits over the inside end of the stud 40 to retain the plug 38 rotatably mounted within cylinder 36 of bracket 20 and thereby hold the cover 34 over the bracket 20 and latch bars 22, 24.

Figure 2:
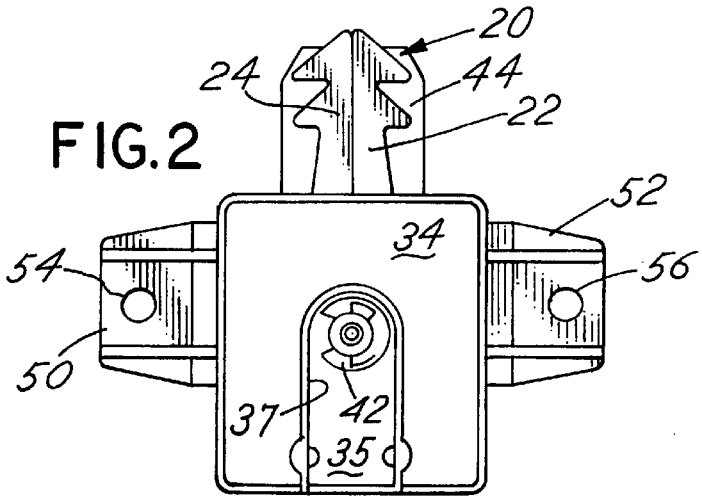
FIG. 2 is a plane view of the lock construction in the unlocked position.
Figure 3:
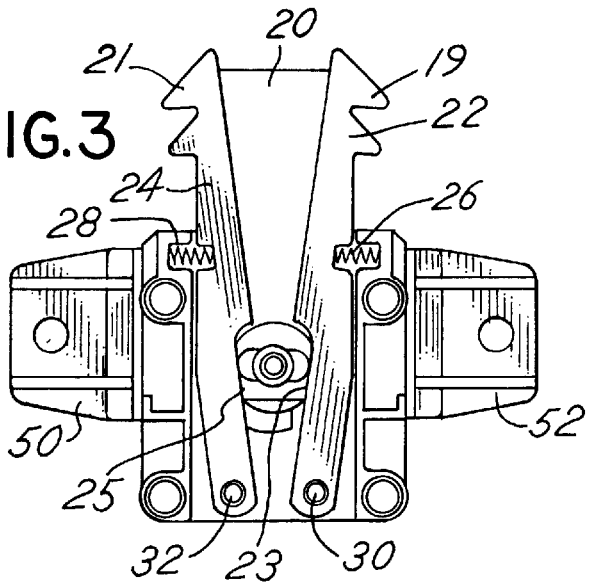
FIG. 3 is a plane view of the lock in the locked position wherein the cover for the housing has been removed to illustrate the internal construction of the bolt lever arms.
Figure 4:
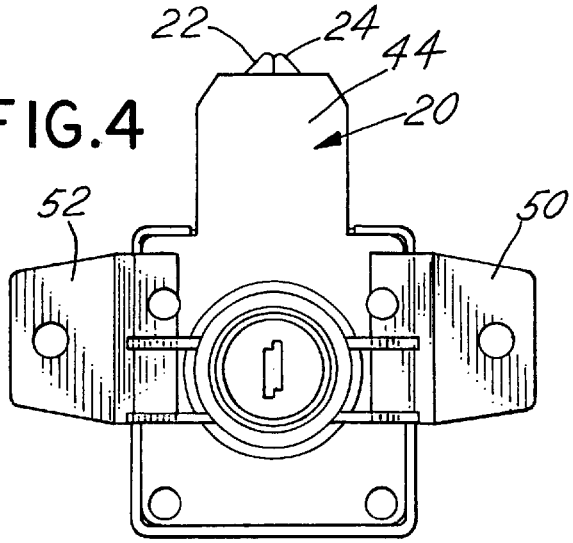
FIG. 4 is a plane view of the front side of the lock in the unlocked position.
Figure 5:
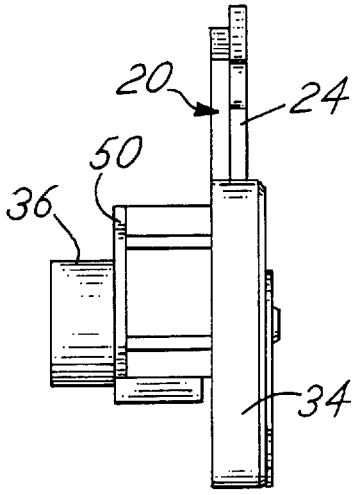
FIG. 5 is a side elevation of the lock of FIGS. 2 and 4.
Figure 6:
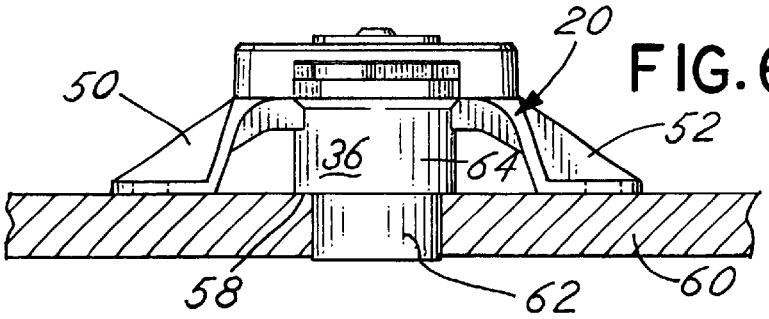
FIG. 6 is a top plane view of the lock of FIG. 4.
Figure 7:
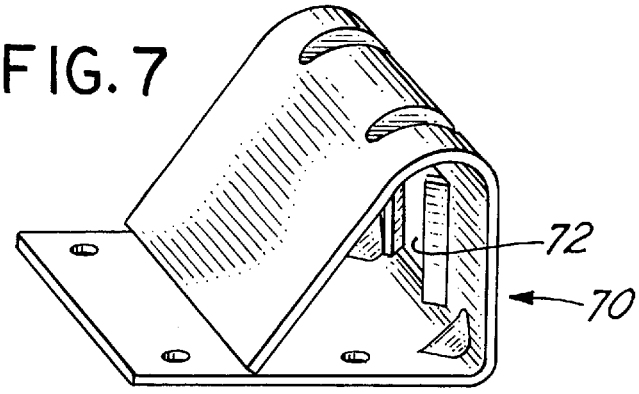
FIG. 7 is a isometric view of the strike utilizing combination with the lock of FIGS. 1–6.
Figure 8:
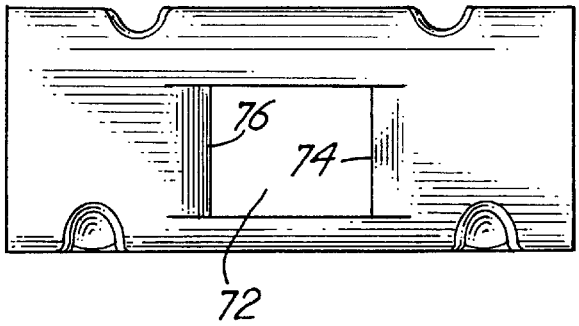
FIG. 8 is a lower or bottom side elevation of the strike of FIG. 7.
Figure 10:
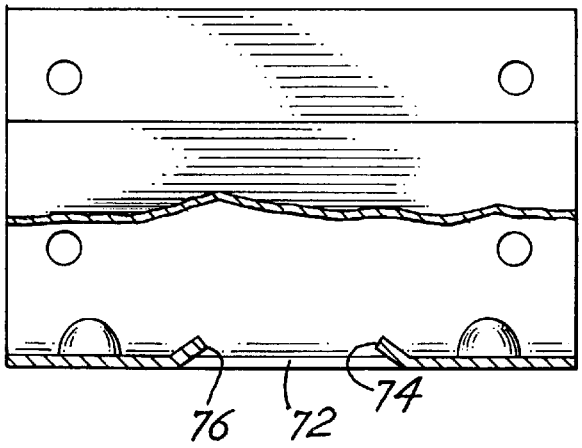
FIG. 10 is a partial sectional view of the strike of FIG. 9 taken along the line 10—10.
Figure 9:
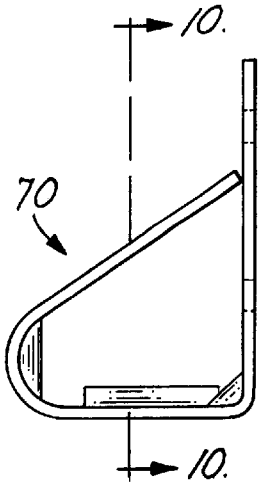
FIG. 9 is a side elevation of the strike of FIG. 7.

The bracket 20 further includes a planar, projecting tongue or plate 44 which is parallel to and fits against the latch bars 22 and 24 to provide protection during movement of those latch bars 22 and 24. The bracket 20 further includes laterally projecting wings or arms 50 and 52 with fastener openings 54 and 56, respectively for attachment of the bracket 20 to the inside face of a car top carrier cover or platform, as the case may be. The cylinder 36 includes an annular surface or land 58 that acts as a sealing surface for the cylinder 36 and for attachment of the bracket to a cover or platform as the case may be. Thus, as depicted in FIG. 6, the bracket 20 may be attached to a housing 60 to position the cylinder 36 including a forward section 62, an annular seal 58 and a rear enlarged diameter section 64 with respect thereto. The wings or arms 50 and 52 include fasteners (not shown) for attachment of the lock to the housing, platform or cover 60 as the case may be. When attached as described, the latch bars 22 and 24 project or extend or pivot laterally from the sides of bracket 20 and are designed to engage with a strike 70 as illustrated in FIG. 1 wherein the strike 70 includes a strike opening 72 having opposite sides 74 and 76. The latch bars 22, 24 are normally biased by springs 26, 28 to the position illustrated in FIG. 2 when the plug stud 40 is rotated so that the stud 40 will not engage against inside cam surfaces 23 and 25 of the latch bars 22 and 24, respectively. Thus, the springs 26, and 28 will bias the latch bars 22 and 24 to the position shown in FIG. 2. The latch bars 22, 24 may then pass into the opening 72 of the strike 70. The plug 38 may then be rotated to the locked position illustrated by FIG. 3 so that the latch bars 22 and 24 will spread or pivot apart, and more particularly, projecting teeth 19 and 21 of the latch bars 22 and 24 will engage through the opening 72 and engage with the opposite sides 74 and 76 of the strike 70. The stud 40 thus provides a means for locking the latch bars 22 and 24.

The plug 38 is keyed so that the key 39 can be removed only when the lock or latch bars 22 and 24 are in the latched or locked position. Otherwise, the key 39 cannot be removed from the plug 38.

The cover or tongue 44 protects a user from inadvertently catching their fingers or hand in the latch bars 22, 24. Additionally, the cover 44 also protects the latch bars 22, 24 from manipulation from the outside of the platform and serves to protect the integrity of the latch bars 22, 24 in the latched position. Further, in the event the springs 26 and 28 break or fail, their breakage or failure is inconsequential with respect to the maintenance of the platform or latch bars 22, 24 in the locked position. The stud 40 acts to engage the lock and maintain it in the locked position and the fact that it is in the locked position, does not depend upon whether the springs 26 and 28 fail.

In the preferred embodiment, the pivot axes of the pivots 30 and 32 are parallel and extend axially in the same direction as the axis of the plug 38. Thus, the stud 40 and the pivot axes of the latch bars 22 and 24 are all parallel. The plug 38 may be easily removed when the assembly is exposed in that the cover 34 provides a retention space 35 for access to the retention clip 42. By removing the retention clip 42, one can remove the plug 38 and cover 34 and thus replace the plug 38 with a rekeyed plug 38. Removal of the entire latch assembly is thus not necessary in order to rekey the lock. The recess 35 also serves to protect the retaining clip 42 so that it will not be inadvertently removed or engaged. The shape of retaining wall 37 about the recess 35 thus facilitates its accessibility as well as its protectability.

While there has been set forth a preferred embodiment of the invention, it is to be understood that the invention is to be limited only by the following claims and equivalents thereof.

What is claimed is:

1. A lock comprising in combination:

a strike attachable to a frame including a strike opening, said opening having first and second space sides;

a bolt housing attachable to a panel, said housing including a mounting plate and a cylinder attached to the mounting plate for receipt of a key actuated plug; said cylinder defining an axis;

first and second bolt lever arms mounted for pivotal movement about axes generally parallel to the cylinder axis on the mounting plate, each arm a strike engaging end, the strike engaging ends opposed to one another;

a rotatable plug mounted in the cylinder, said plug including a stud extending intermediate the bolt lever arms, said stud having a shaped section which upon rotation engages the bolt lever arms and effects pivotal movement of the lever arms between a position of engagement and a position of non-engagement with the sides of the strike opening whereby the lock is locked when the lever arms engage the strike opening and unlocked when the lever arms disengage from the strike opening; and at least one spring member for biasing at least one bolt lever arm pivotally away from engaging the strike.

2. The lock of claim 1 wherein the bolt lever arms are pivotally connected to the housing and project from the housing; and wherein the bolt lever arms are spring biased pivotally toward each other to the unlocked position.

3. A lock comprising in combination:

strike attachable to a frame including a strike opening, said opening having first and second space sides;

a bolt housing attachable to a panel, said housing including a mounting plate and a cylinder attached to the mounting plate for receipt of a key actuated plate, said cylinder defining an axis;

first and second bolt lever arms mounted for pivotal movement about axes generally parallel to the cylinder axis on the mounting plate, each arm a strike engaging end, the strike engaging ends opposed to one another;

a rotatable plug mounted in the cylinder, said plug including a stud extending intermediate the bolt lever arms, said stud having a shaped section which upon rotation engages the bolt lever arms and effects pivotal movement of the lever arms between a position of engagement and a position of non-engagement with the sides of the strike opening whereby the lock is locked when the lever arms engage the strike opening and unlocked when the lever arms disengage from the strike opening;

wherein the bolt lever ams are pivotally connected to the housing and project from the housing, and wherein the bolt lever arms are spring biased pivotally toward each other to the unlocked position.

4. The lock of claim 1 or 3 wherein the plug and lever arms are all rotatable about parallel axes.

5. The lock of claim 1 or 3 wherein at lease one strike engaging ends of the bolt lever arms comprises a detent for engaging the strike.

6. The lock of claim 3 including at least one spring member for biasing at least one bolt lever arm pivotally away from engaging the strike.

7. The lock of claim 1 or 3 wherein the bolt lever arms comprise planer plate members.

* * * * *